US006736502B2

(12) United States Patent
Deguchi

(10) Patent No.: US 6,736,502 B2
(45) Date of Patent: May 18, 2004

(54) EXPANDABLE/CONTRACTIBLE TYPE PORTABLE PRINTER

(75) Inventor: Masanobu Deguchi, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/421,865

(22) Filed: Apr. 24, 2003

(65) Prior Publication Data

US 2003/0202083 A1 Oct. 30, 2003

(30) Foreign Application Priority Data

Apr. 24, 2002 (JP) ..... 2002-122846

(51) Int. Cl.[7] ..... B41J 29/13; B41J 3/36
(52) U.S. Cl. ..... 347/108; 347/109
(58) Field of Search ..... 347/108, 109, 347/1; 346/145, 143; 400/691, 88

(56) References Cited

U.S. PATENT DOCUMENTS 5,172,903 A * 12/1992 Haneda et al. ..... 271/171

FOREIGN PATENT DOCUMENTS

JP 10-230662 A 9/1998

* cited by examiner

*Primary Examiner*—Stephen D. Meier
*Assistant Examiner*—An H. Do
(74) *Attorney, Agent, or Firm*—Birch, Stewart, Kolasch & Birch, LLP

(57) ABSTRACT

An expandable/contractible type portable printer is provided, including: an expandable/contractible casing including an enclosure and opposite outer jackets expandably and contractibly mounted at opposite sides of the enclosure; a printing unit disposed in the casing for printing on a recording sheet by jetting ink onto the recording sheet from a printing head mounted on a carriage which is reciprocatively movable in a primary scanning direction; and a sheet feed unit disposed in the casing for feeding the recording sheet in a secondary scanning direction, the opposite outer jackets being coupled to the enclosure by a rack-and-pinion mechanism so as to be expandable and contractible with respect to the enclosure evenly in opposite lateral directions.

13 Claims, 7 Drawing Sheets

EXPANDABLE/CONTRACTIBLE TYPE PORTABLE PRINTER

This nonprovisional application claims priority under 35 U.S.C. § 119(a) on Patent Application No(s). 2002-122846 filed in JAPAN on Apr. 24, 2002, which is(are) herein incorporated by reference.

BACKGROUND OF THE INVENTION

1. Field of the Invention

The present invention relates to expandable/contractible type portable printers.

2. Description of the Related Art

Ink jet printers in general are constructed to be capable of printing on recording sheets of A4 size or larger and hence are relatively bulky and heavy. Such a printer is inconvenient for the user to carry, and frequently occupies a large space when not in use. In attempt to overcome such inconveniences, a portable image output device capable of expanding/contracting the printing area in the primary scanning direction has been proposed in Japan Patent Laid Open Hei No. 10-230662 for example.

This image output device has two expandable/contractible rods forming a guide shaft for guiding a whole device body and a carriage in the primary scanning direction. The expandable/contractible rods each comprise a larger tubular shaft, and a smaller shaft telescopically movable in the larger shaft. The image output device is so constructed that the guide shaft supports a guide shaft bearing of the carriage in a non-contact state by utilizing magnetic and/or electrostatic repulsion.

The image output device employing such an expandable/contractible guide shaft has the drawback that when the guide shaft is expanded to the maximum, the overlapping portion between the larger shaft and the smaller shaft becomes so small that a sufficient strength for use cannot be ensured, resulting in the guide shaft likely to collapse.

Further, since the carriage is supported in a non-contact state above the guide shaft so as to avoid the influence of a stepped portion defined on the expandable/contractible guide shaft, the carriage is greatly influenced when the whole device is given an external shock or the carriage receives vibration or the like from the carriage driving source, and as a result, vibration of the carriage is generated having an amplitude corresponding to the gap between the carriage and the guide shaft about the axis of the guide shaft, thereby deteriorating the quality of printed images.

SUMMARY OF THE INVENTION

It is an object of the present invention to provide an expandable/contractible type portable printer which is capable of establishing a large amount of expansion/contraction while ensuring a high coupling strength between an enclosure and opposite outer jackets when the printer is in use.

According to the present invention, there is provided an expandable/contractible type portable printer comprising:

an expandable/contractible casing including an enclosure and opposite outer jackets expandably and contractibly mounted at opposite sides of the enclosure;

a printing unit disposed in the casing for printing on a recording sheet by jetting ink onto the recording sheet from a printing head mounted on a carriage which is reciprocatively movable in a primary scanning direction; and a sheet feed unit disposed in the casing for feeding the recording sheet in a secondary scanning direction, the opposite outer jackets being coupled to the enclosure by means of a rack-and-pinion mechanism so as to be expandable and contractible with respect to the enclosure evenly in opposite lateral directions.

It is desired that the expandable/contractible type portable printer have a carriage guide member of a stepless structure for reducing the influence of vibration from a carriage driving motor or the like.

In the printer of this construction, the opposite outer jackets are coupled to the enclosure by means of the rack-and-pinion mechanism so as to be expandable and contractible with respect to the enclosure evenly in the opposite lateral directions. This feature facilitates the operation of expanding and contracting the casing thereby to improve the ease of use of the printer and ensures a high strength of coupling between the enclosure and the opposite outer jackets when the printer is in use.

The rack-and-pinion mechanism employed in the printer allows an increased amount of expansion/contraction of the casing to be established, thereby enabling printing on large-size recording sheets when the printer is in use and allowing the printer to be contracted into a compact size when the printer is not in use.

The foregoing and other objects, features and attendant advantages of the present invention will become apparent from the reading of the following detailed description in conjunction with the accompanying drawings.

DETAILED DESCRIPTION OF THE PREFERRED EMBODIMENTS

Hereinafter, an expandable/contractible type portable printer embodying the present invention will be described in detail with reference to the accompanying drawings.

Figure 1A:
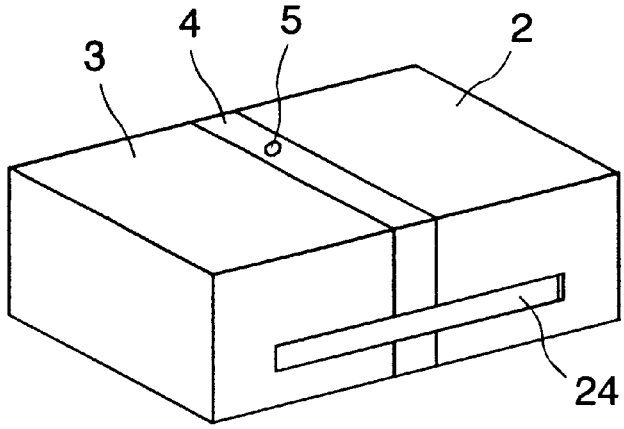
FIGS. 1A and 1B are perspective views showing an contracted state and an expanded state, respectively, of an expandable/contractible type portable printer according to an embodiment of the present invention.
Figure 1B:
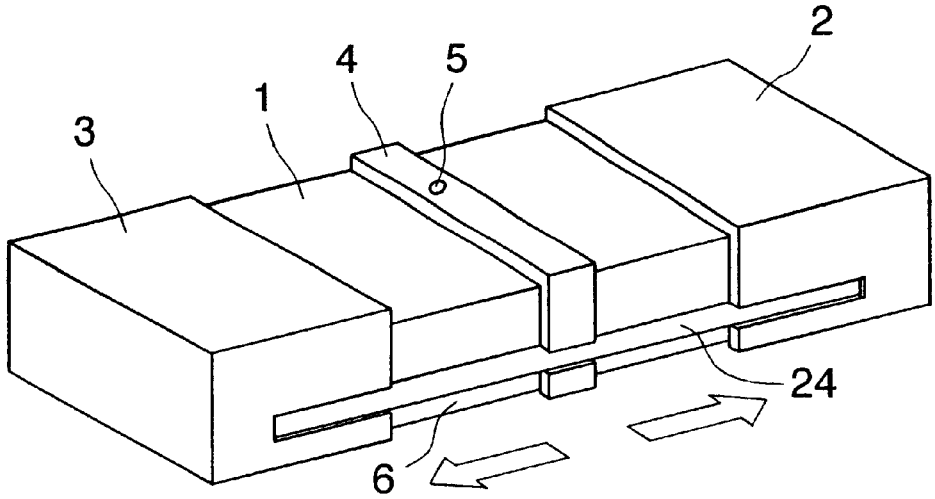
Figure 2A:
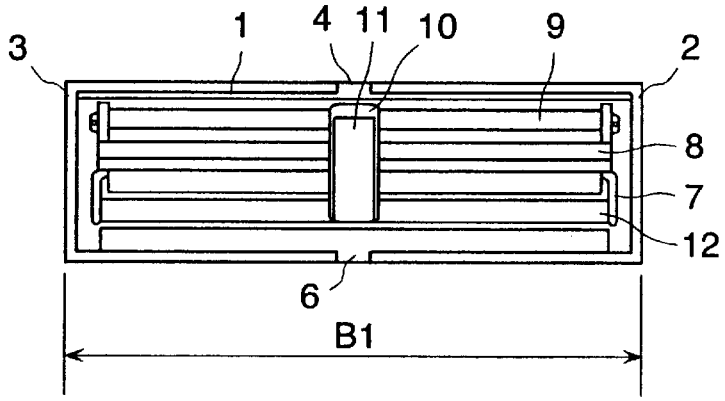
FIGS. 2A and 2B are vertical sectional views showing the contracted state and the expanded state, respectively, of the expandable/contractible type portable printer.
Figure 2B:
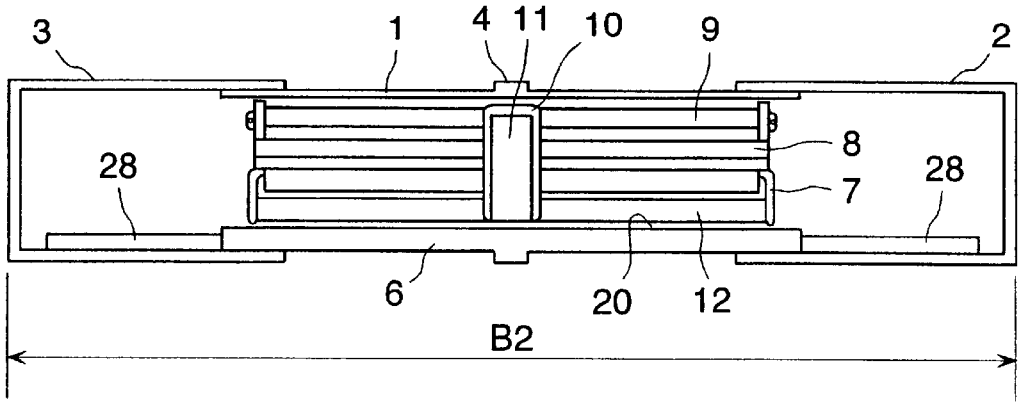
Figure 3A:
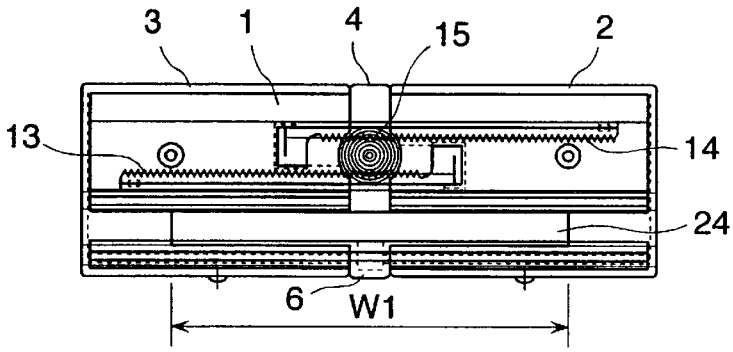
FIGS. 3A and 3B are schematic views, as viewed from a front side, illustrating a contracted state and an expanded state, respectively, of a rack-and-pinion mechanism used in the expandable/contractible type portable printer.
Figure 3B:
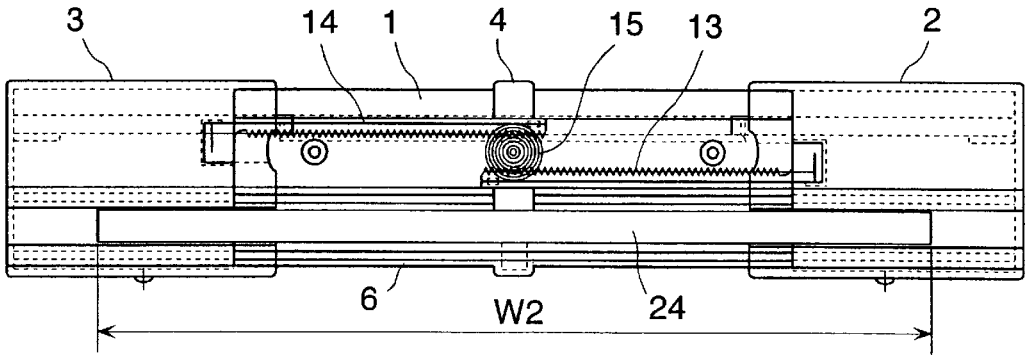
Figure 4:
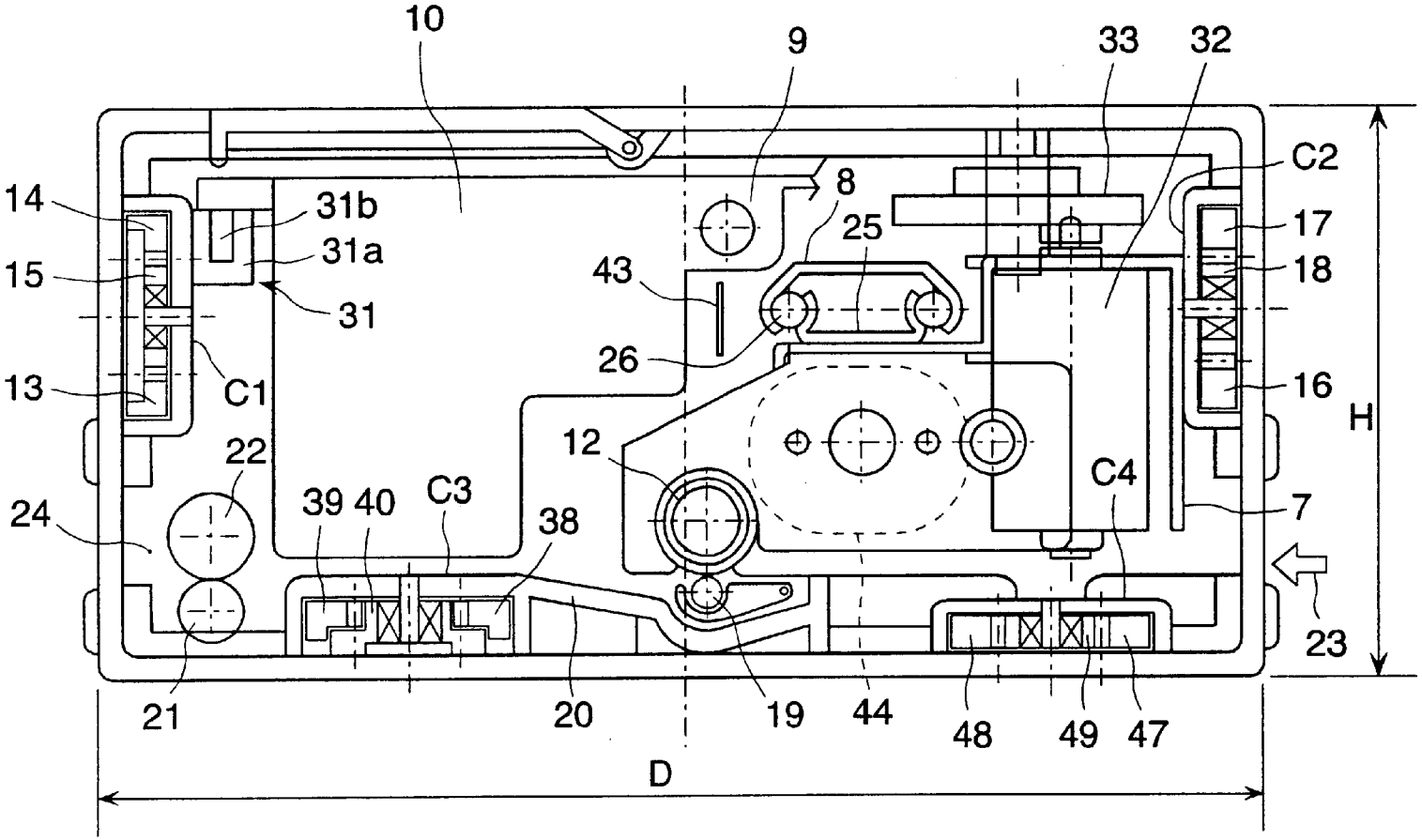
FIG. 4 is a side view, in vertical section, of the expandable/contractible type portable printer.

FIGS. 1A and 1B are perspective views showing an contracted state and an expanded state, respectively, of the expandable/contractible type portable printer (hereinafter referred to as the "printer" simply); FIGS. 2A and 2B are vertical sectional views, as viewed from a front side, showing the contracted state and the expanded state, respectively, of the printer; FIGS. 3A and 3B are schematic views illustrating the operation of a rack-and-pinion mechanism used in the printer; and FIG. 4 is a side view, in vertical section, of the printer. As shown in these figures, the printer includes: a box-shaped expandable/contractible casing which is expandable and contractible in opposite lateral directions and which comprises an enclosure 1 and opposite outer jackets 2 and 3 mounted at opposite sides of the enclosure 1 so as to be expandable and contractible with respect to the enclosure 1 evenly in the opposite lateral directions; a printing unit disposed in the casing for printing on a recording sheet by jetting ink onto the recording sheet from an ink head (printing head) 11 mounted on a carriage 10 which is reciprocatively movable in a primary scanning direction; and a sheet feed unit disposed in the casing for feeding the recording sheet in a secondary scanning direction.

When in use, the printer assumes the expanded state shown in FIG. 1B (or a size for printing on a recording medium of a maximum size). When not in use, the printer assumes the contracted state shown in FIG. 1A (or a minimum size for storage). The contracted state is also shown in FIGS. 2A and 3A, while the expanded state also shown in FIGS. 2B and 3B. In FIGS. 1A and 1B, reference numeral 4 denotes a central ridge of the enclosure 1, reference numeral 5 denotes a power-on indicator LED and reference numeral 6 denotes a base plate. Referring to FIGS. 2A and 2B, there are shown a frame 7 secured to the enclosure 1, a slide rail 8, a single stepless carriage scan shaft 9, the carriage 10, the ink head (printing head) 11, a sheet feed roller 12, a platen 20 formed on the base plate 6, and auxiliary platen plates telescopically accommodated in the base plate 6.

Referring to FIGS. 3A and 3B, there are shown a right outer jacket front rack gear 13 secured to a front side of the right outer jacket 2 so as to extend in the primary scanning direction, a left outer jacket front rack gear 14 secured to the front side of the left outer jacket 3 so as to extend in the primary scanning direction, and a front washer faced spur gear 15 rotatably supported at a fixed position centrally of a front side of the enclosure 1 and meshing with the two rack gears 13 and 14 on the upper and lower sides thereof. The rack gears 13 and 14 are slidably accommodated in a rack casing C1 (see FIG. 4) formed in the enclosure 1 to ensure their reliable meshing with the spur gear 15, thereby ensuring a smooth expanding/contracting operation without looseness.

Such rack-and-pinion mechanisms are also provided on the rear side of the device body (printer body) and on the front and rear sides of the bottom of the device body for stabilizing the expanding/contracting operation of the right outer jacket 2 and left outer jacket 3 with respect to the enclosure 1 and enhancing the strength of coupling of the outer jackets 2 and 3 to the enclosure 1. Specifically, as shown in FIG. 4, on the rear side of the device body, a right outer jacket rear rack gear 16 secured to a rear portion of the right outer jacket 2 and a left outer jacket rear rack gear 17 secured to a rear portion of the left outer jacket 3 mesh with a rear washer faced spur gear 18 rotatably supported at a fixed position centrally of a rear side of the enclosure 1.

On the front side of the bottom of the device body, a right outer jacket front bottom rack gear 38 secured to a front bottom portion of the right outer jacket 2 and a left outer jacket front bottom rack gear 39 secured to a front bottom portion of the left outer jacket 3 mesh with a front bottom washer faced spur gear 40 rotatably supported at a fixed position centrally of a front side of the bottom of the enclosure 1. On the rear side of the bottom of the device body, a right outer jacket rear bottom rack gear 47 secured to a rear bottom portion of the right outer jacket 2 and a left outer jacket rear bottom rack gear 48 secured to a rear bottom portion of the left outer jacket 3 mesh with a rear bottom washer faced spur gear 49 rotatably supported at a fixed position centrally of a rear portion of the bottom of the enclosure 1.

The pairs of rack gears 16 and 17, rack gears 38 and 39 and rack gears 47 and 48 are slidably accommodated in rack casings C2, C3 and C4, respectively, formed inside the enclosure 1 to ensure their reliable meshing with the respective spur gears 18, 40 and 49 and enhance the strength of coupling between the enclosure 1 and the outer jackets 2 and 3, thereby ensuring a smooth expanding/contracting operation without looseness. The present invention does not intend to limit the number and the arrangement of such rack-and-pinion mechanisms and permits appropriate selection and setting of the number and the arrangement of rack-and-pinion mechanisms to be made. For example, if the rack-and-pinion mechanism accommodated in the rack casing C3 at the front bottom portion of the device body provides a sufficient coupling strength at the bottom of the casing, it is possible to eliminate the rack-and-pinion mechanism accommodated in the rack casing C4.

The printer has outside dimensions of 50×100×160 mm ($H \times D \times B_1$) in its contracted state. For use, when the right and left outer jackets 2 and 3 are drawn toward the right-hand side and the left-hand side by hand, the four rack-and-pinion mechanisms allow the outer jackets 2 and 3 to smoothly expand from the enclosure 1 evenly in the opposite lateral directions. Thus, the printer assumes the expanded state shown in FIG. 1B where the outside dimensions of the printer are 50×100×280 mm ($H \times D \times B_2$) at maximum. As shown in FIGS. 3A and 3B, the width $W_1$ of a sheet ejection outlet 24 defined on the front side of the device body when the printer is in the contracted state for storage shown in FIG. 1A is 110 mm, while the width $W_2$ of the sheet ejection outlet 24 defined when the printer is in the most expanded state for use shown in FIG. 1B is 230 mm.

On the rear side of the device body is defined a sheet feed inlet 23 (see FIG. 4) corresponding to the sheet ejection outlet 24. The sheet feed inlet 23 and the sheet ejection outlet 24 are on the same level of height so that a recording sheet passing therebetween becomes parallel with a lower surface of the ink head 11. The width of the sheet feed inlet 23 is set based on the width of a recording sheet to be used. Though not shown, the sheet feed inlet 23 is provided with right and left guides for guiding recording sheets.

This embodiment is adaptable for a maximum sheet width of A4 size or 8.5 inches. Accordingly, the volume ratio of the printer between the contracted state for storage and the expanded state for use with an A4 size sheet is 57:100. Thus, the printer can be rendered compact enough to be carried together with a notebook personal computer by contraction. As the case may be, the printer can be stored in a desk or used as a bookstand. If it is desired that the printer be adaptable for an A3 size sheet for example, it is sufficient to increase the widthwise dimension of the printer for storage to a certain extent. In this way the present invention is flexibly adaptable for sheets of various sizes.

Figure 5:
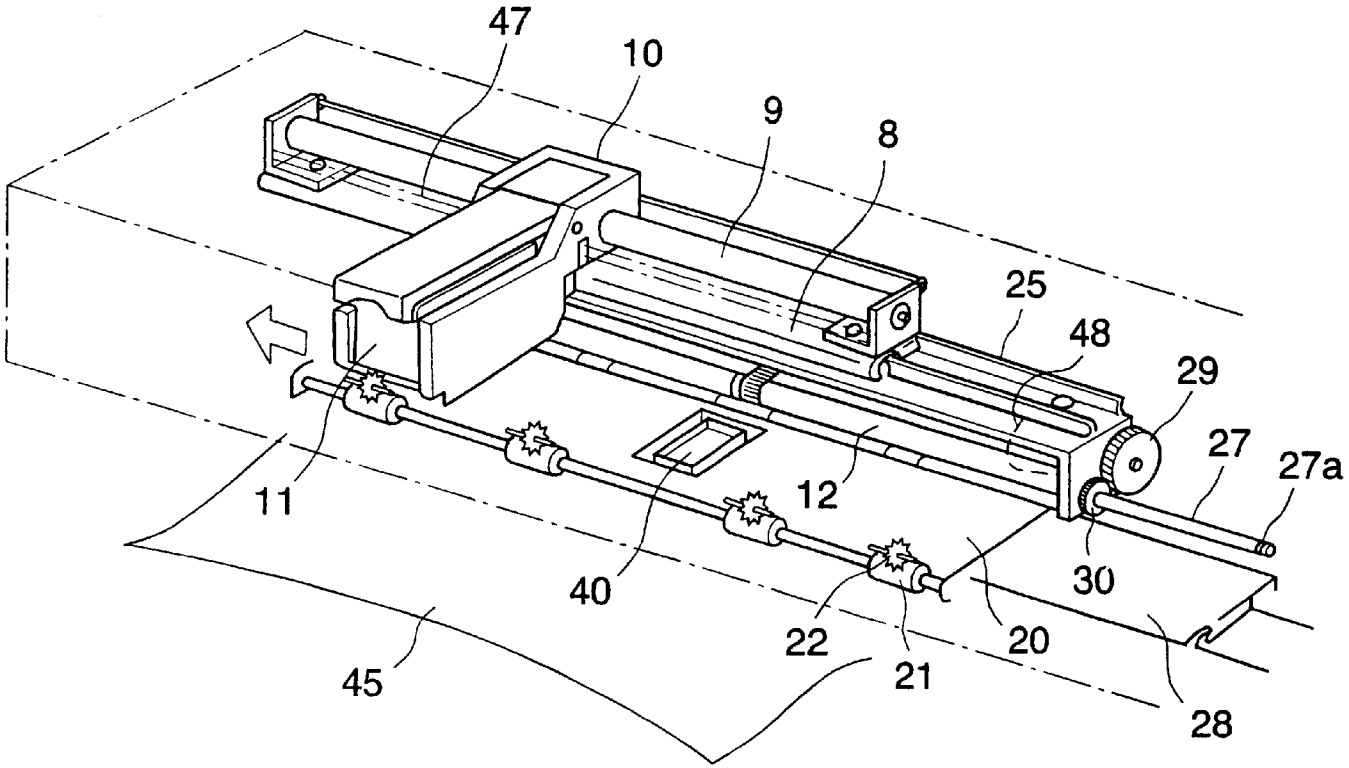
FIG. 5 is a perspective view showing the internal structure of the expandable/contractible type portable printer.
Figure 6:
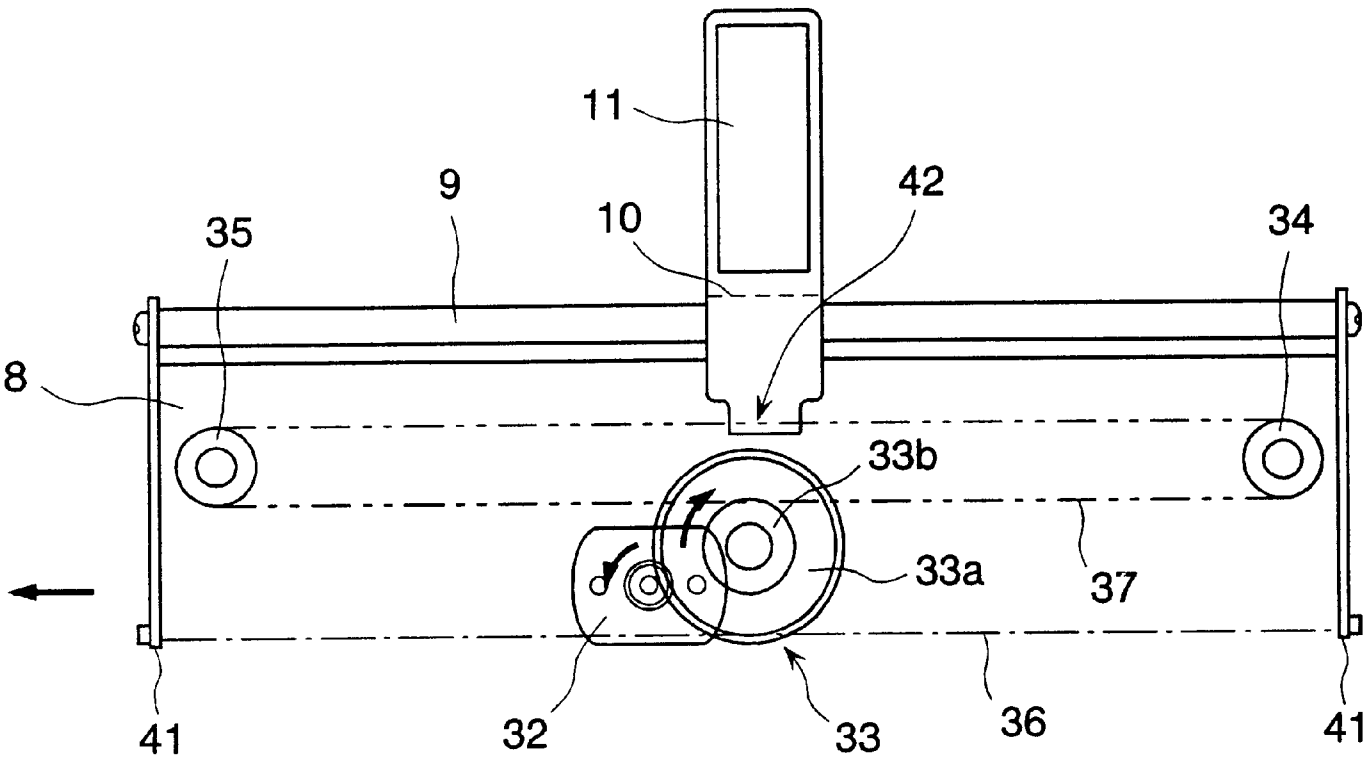
FIG. 6 is a schematic top plan view showing a carriage driving mechanism of the expandable/contractible type portable printer.

Referring to FIGS. 4 to 6, the operation of the carriage 10 is described below.

Since the slide rail 8 and the carriage 10 located in the enclosure 1 do not operate in the expanded state shown in FIG. 2B where the right outer jacket 2 and the left outer jacket 3 are drawn to the opposite sides, the inside of each of the outer jackets 2 and 3 is vacant. When the printer is powered ON by manipulating a power switch (not shown) provided on the enclosure 1, the shaft of a carriage driving motor 32 mounted on the frame 7 in the enclosure 1 as shown in FIG. 4 revolves leftwardly (see FIG. 6) to cause the slide rail 8 to slide to the left as shown in FIG. 5.

Specifically speaking, the slide rail 8 is slidably fitted over a slide rail support 25 through a retainer 26 comprising a pair of ball bearing trains, as shown in FIG. 4. The slide rail support 25 is secured to the frame 7 by means of a screw (not shown), and the frame 7 is secured to the enclosure 1 by means of a screw (not shown).

As shown in FIG. 6, a first wire 36 spans between opposite rear ends (opposite lower ends in FIG. 6) of the slide rail 8 and is trained about a first wire driving pulley 33*a* that is coupled to the carriage driving motor 32 for transmission. When the shaft of the carriage driving motor 32 is caused to revolve leftwardly, the first wire driving pulley 33*a* rotates rightwardly to cause the slide rail 8 to slide to the left as described above.

On the other hand, a second wire 37 connected to a rear portion of the carriage 10 is trained about a second wire driving pulley 33*b* via pulleys 34 and 35 located at opposite ends of the slide rail 8. The second wire driving pulley 33*b* and the first wire driving pulley 33*a*, which are coaxially assembled together, constitute a wire driving pulley 33 coupled to the carriage driving motor 32 for transmission.

With this arrangement, as the shaft of the carriage driving motor 32 revolves leftwardly, the slide rail 8 slides to the left while at the same time the carriage 10 moves to the left along the carriage scan shaft 9 secured to the slide rail 8. In the subject embodiment, the ratio between the diameter of the first wire driving pulley 33*a* and that of the second wire driving pulley 33*b* is set to 2:1. By so setting, the moving speed of the carriage 10 relative to the slide rail 8 is set to ½ of the moving speed of the slide rail 8, which makes the movement of the carriage 10 smooth and allows positioning control over the carriage 10 to be exercised accurately, resulting in good printing quality.

When the revolution of the shaft of the carriage motor 32 is switched to rightward revolution, the directions indicated by respective arrows in FIG. 6 are reversed and, hence, the slide rail 8 slides to the right while the carriage 10 moves to the right as viewed from the front side. As the carriage 10 moves as described above, a photosensor provided at the carriage 10 reads a timing fence 43 mounted on the frame 7 thereby controlling the moving speed of the carriage 10 for proper printing.

On the other hand, sheet feeding is achieved by allowing a recording sheet 45 (see FIG. 5) to be taken in by the sheet feed roller 12 rotated by a sheet feed motor 44 (see FIG. 4) located in the enclosure 1. The sheet feed roller 12 takes in the recording sheet 45 and feeds it intermittently over the platen 20 to a sheet ejection roller 21. More specifically, the sheet feed roller 12 rotates by an amount corresponding to a necessary feed synchronously with the operation of the ink head 11 and then stops rotating for allowing printing to be performed. This operation is performed repeatedly.

As shown in FIG. 4, a pinch roller 19 is pressed against the sheet feed roller 12 by a biasing spring force and pinches and feeds a recording paper in cooperation with the sheet feed roller 12 by the force of pressing the pinch roller 19 against the sheet feed roller 12. Similarly, a sheet ejection star roller 22 is pressed against the sheet ejection roller 21 by a biasing spring force and ejects a recording sheet by the force of pressing the sheet ejection star roller 22 against the sheet ejection roller 21.

The sheet feed roller 12 has a length shorter than the width of the printer in the contracted state and hence contacts only a 140 mm-wide central portion of a recording sheet if the sheet is of A4 size. Though the length of the sheet feed roller 12 is sufficient to provide a required feeding force, it is necessary to provide a guide for guiding a remaining (excess) portion having a width of 70 mm, which is the difference resulting from subtraction of 140 mm from the width 210 mm of the A4 size sheet. This embodiment employs a hollow pipe as the sheet feed roller 12 in which auxiliary sheet feed roller inner shafts 27 are telescopically accommodated.

The sheet feed roller inner shafts 27 are accommodated within the sheet feed roller 12 when the printer is in the contracted state for storage. The sheet feed roller inner shafts 27 are each formed with a circumferential groove 27*a*. When the printer is to be used, the sheet feed roller inner shafts 27 are drawn out following the expanding operation of the opposite outer jackets 2 and 3 with the circumferential grooves 27*a* engaging corresponding ribs (not shown) respectively formed at the two outer jackets 2 and 3. With the sheet feed roller inner shafts 27, 35 mm-wide halves of the 70 mm-wide excess portion of the recording sheet can be stably fed and guided within the respective outer jackets 2 and 3.

Similarly, the auxiliary platen plates 28 are telescopically accommodated in the base plate 6 formed with the platen 20 (see FIG. 5). When the printer is to be used, the auxiliary platen plates 28 each having an end anchored to a rib (not shown) formed at each of the outer jackets 2 and 3 are drawn out following the expanding operation of the opposite outer jackets 2 and 3 to guide excess portions of the recording sheet extending off the platen 20. In the subject embodiment, the base plate 6 serves also as the rack casing C3 formed inside the enclosure 1. As described earlier, the rack casing C3 accommodates therein the front bottom washer faced spur gear 40 rotatably supported and the rack gears 38 and 39 located on opposite sides thereof as meshing with the spur gear 40.

The carriage 10 carrying the ink head 11 has a rear portion supported by the carriage scan shaft 9 secured to the opposite ends of the slide rail 8 as shown in FIG. 6. Since a front portion of the carriage 10 would be vertically unstable with such a rear support only, the front portion is supported by a guide rail 31 provided inside a front portion of the enclosure 1 as shown in FIG. 4.

The guide rail 31, which is expandable and contractible with the expanding/contracting operation of the opposite outer jackets 2 and 3, comprises a laterally extending receiver groove 31*a* of a concave shape in section formed inside the front portion of the enclosure 1, and insert members 31*b* slidably fitted in the receiver groove 31*a*. The carriage 10 has a forwardly projecting support portion which is supported on the guide rail 31 for sliding contact therewith. Thus, the carriage 10 can be stably moved along the carriage scan shaft 9 during printing.

Figure 7:
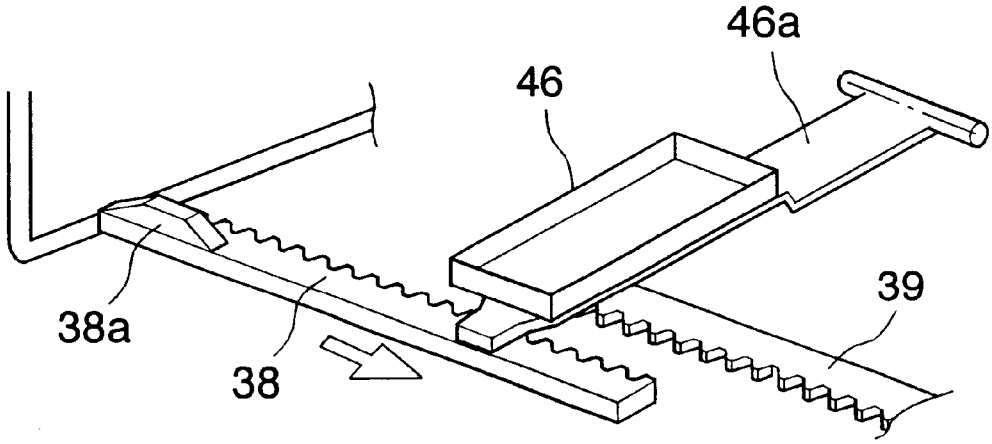
FIG. 7 is a fragmentary perspective view showing a printing head capping mechanism used in the expandable/contractible type portable printer.

The ink head 11 fitted inside the carriage 10 is capped during storage of the printer to prevent the nozzle of the ink head 11 from drying. By utilizing returning of the carriage 10 to the center of the enclosure 1 as the slide rail 8 is pushed back with the contracting operation of the opposite outer jackets 2 and 3 for storage of the printer, a capping rubber member 46 provided in a central hole of the platen 20 as shown in FIG. 5 is pressed up from below with a projection (press-up member) 38*a* formed on the right outer jacket front bottom rack gear 38 secured to the front bottom portion of the right outer jacket 2 (see FIG. 7) to cap the ink head 11. The capping rubber member 46 can be pressed up by an arrangement wherein: the capping rubber member 46 is fixedly placed on a tip portion of a support plate 46*a* pivotally fitted at its base portion to the frame 7 located in the enclosure 1; and the projection 38*a* formed on the right outer jacket front bottom rack gear 38 is adapted to come into slide contact with the underside of the support plate 46*a* when the opposite outer jackets 2 and 3 are contracted or closed.

As described above, by the provision of the slide rail 8 slidably mounted on the frame 7 in the enclosure 1 and provided with the carriage scan shaft 9 for guiding the carriage 10 in the primary scanning direction, the expandable/contractible type portable printer according to this embodiment can ensure a large amount of expansion/contraction in the primary scanning direction, so that the printer becomes capable of printing on a recording sheet of a large size as well as of contracting into a compact size for carrying or storage.

The use of the rack-and-pinion mechanisms enables the opposite outer jackets 2 and 3 to expand and contract evenly with respect to the enclosure 1 in cooperation with each other even when only one outer jacket is manipulated, thus making the expanding/contracting operation easy and reliable. Particularly when the printer is used as expanded, the rack-and-pinion mechanisms firmly coupling the opposite outer jackets 2 and 3 to the enclosure 1 including the base plate 6 formed with the platen 20 can ensure a high coupling strength stably, which provides for a high printing quality with reduced troubles.

Since the printer has such a double slide arrangement as to guide the carriage 10 by means of the single stepless carriage scan shaft 9 and slide the slide rail 8 fitted with the carriage scan shaft 9 relative to the device body, it is possible to increase the movable range of the carriage 10 (scanning width in the primary scanning direction) as well as to reduce the influence of vibration on printing substantially by virtue of the provision of the stepless carriage scan shaft 9 instead of the conventional expandable/contractible rod having a step.

Further, the driving control over the carriage 10 can be simplified by the arrangement wherein: the slide rail 8 is coupled to the first wire driving pulley 33*a* through the first wire 36 for transmission while the carriage 10 coupled to the second wire driving pulley 33*b* through the second wire 37; and the wire driving pulley 33 consisting of the two pulleys 33*a* and 33*b* integrally assembled together is driven by the single carriage driving motor 32.

Though not shown, for allowing the casing to expand and contract with high operability and realizing more stabilized printing operation, an arrangement may be employed such that a resilient member having a high friction coefficient such as of rubber is bonded to the underside of the enclosure 1 while a pad member having a low friction coefficient such as of a resin is provided on the underside of each of the opposite outer jackets 2 and 3. Such an arrangement makes it possible to stabilize the placement of the relatively heavy enclosure 1, absorb external shock and stabilize the printing operation. Further, when the casing is to be expanded and contracted, the opposite outer jackets 2 and 3 having a low friction coefficient can be expanded and contracted with respect to the enclosure with high operability.

The present invention is not limited to the construction of the expandable/contractible type portable printer according to the foregoing embodiment. It is sufficient for the printer of the present invention to comprise: at least, an expandable/contractible casing including an enclosure and opposite outer jackets expandably and contractibly mounted at opposite sides of the enclosure; a printing unit disposed in the casing for printing on a recording sheet by jetting ink onto the recording sheet from a printing head mounted on a carriage which is reciprocatively movable in a primary scanning direction; and a sheet feed unit disposed in the casing for feeding the recording sheet in a secondary scanning direction. It is needless to say that the present invention is applicable to various printers, regardless of their types and structures. As the need arises, the printer of the present invention may be variously modified in part and in design without departing from the spirit and scope of the present invention.

As described above, the present invention has the following advantages.

The printer of the present invention has the feature that the opposite outer jackets are coupled to the enclosure by means of the rack-and-pinion mechanism so as to be expandable and contractible with respect to the enclosure evenly in opposite lateral directions. This feature facilitates the operation of expanding and contracting the casing thereby to improve the ease of use of the printer and ensures a high coupling strength when the printer is in use.

The rack-and-pinion mechanism employed in the printer allows an increased amount of expansion/contraction of the casing to be established, thereby enabling printing on a recording sheet of a large size to be achieved when the printer is in use and allowing the printer to be contracted into a compact size when the printer is not in use.

Since the opposite outer jackets are fitted with respective racks which mesh with upper and lower parts of the pinion mounted at the casing, it is easy to realize the arrangement for allowing the opposite outer jackets to expand and contract with respect to the enclosure evenly in the opposite lateral directions.

The provision of such rack-and-pinion mechanisms on the front side, rear side and bottom of the expandable/contractible casing enables the coupling strength of the casing to be enhanced three-dimensionally, thereby ensuring stabilized printing and enhancing the durability of the printer.

Since the base plate disposed in a lower portion of the enclosure is coupled to the opposite outer jackets by means of rack-and-pinion mechanism, the coupling strength around the platen at the lower portion of the enclosure can be enhanced.

The feature that the auxiliary platens are telescopically accommodated in the base plate, enables the auxiliary platens to receive opposite edge portions of a recording sheet that extend off the platen when the opposite outer jackets are expanded in the opposite lateral directions.

The feature that the carriage is supported and guided by the single stepless carriage scan shaft, stabilizes the movement of the carriage and reduces the influence of vibration from a driving source and the like, thereby stabilizing the printing operation.

Since the movement of the slide rail in the primary scanning direction is added to the movement of the carriage along the carriage scan shaft in the primary scanning direction, the movable range of the carriage in the primary scanning direction relative to a recording sheet can be expanded to ensure an increased printing width, thereby allowing printing on a large-size recording sheet to be achieved.

The feature that the carriage driving motor is capable of moving the slide rail by means of the first wire while moving the carriage supported and guided by the carriage scan shaft mounted over the slide rail by means of the second wire, allows the carriage to be moved within a wide moving range including the moving range of the slide rail by a single driving source.

The feature that the first wire driving pulley and the second wire driving pulley are coaxially assembled together, makes it possible to simplify the arrangement for transmitting driving power from the carriage driving motor to the two pulleys.

Since the ratio between the diameter of the first wire driving pulley and that of the second wire driving pulley is set to 2:1, the moving speed of the carriage relative to the slide rail 8 is set to ½ of the moving speed of the slide rail 8, which makes the movement of the carriage smooth and allows positioning control over the carriage to be exercised accurately, resulting in good printing quality.

Since the carriage is positioned centrally of the enclosure when the opposite outer jackets are contracted, the printer can have a compact structure in which the printing unit and the sheet feed unit mounted in the enclosure are compactly centralized in a central portion of the enclosure.

The provision of the capping member for hermetically sealing the printing head makes it easy to realize the arrangement for capping the printing head when the printer is not in use.

The provision of the press-up member on one of the racks respectively mounted at the opposite outer jackets, enables the cap to be pressed against and hermetically seal the printing head by means of the press-up member when the opposite outer jackets are contracted with respect to the enclosure.

The arrangement wherein: the expandable/contractible guide rail comprises the laterally extending receiver groove formed above the sheet ejection outlet defined in a front portion of the enclosure, and a pair of insert members which are secured to the opposite outer jackets, respectively, and slidably fitted in the receiver groove; and the carriage has an ejection-side portion slidably placed on the guide rail, enables the ejection-side portion of the carriage 10 to be stably held both in the state for use in which the casing is expanded and the state for storage in which the casing is contracted.

The arrangement wherein the resilient member having a high friction coefficient is bonded to the underside of the enclosure while the pad member having a low friction coefficient provided on the underside of each of the opposite outer jackets, makes it possible to stabilize the placement of the enclosure, absorb external shock and stabilize the printing operation. Further, when the casing is to be expanded and contracted, the opposite outer jackets having a low friction coefficient are allowed to expand and contract with respect to the enclosure with high operability.

What is claimed is:

1. An expandable/contractible type portable printer comprising:

an expandable/contractible casing including an enclosure and opposite outer jackets expandably and contractibly mounted at opposite sides of the enclosure;

a printing unit disposed in the casing for printing on a recording sheet by jetting ink onto the recording sheet from a printing head mounted on a carriage which is reciprocatively movable in a primary scanning direction; and a sheet feed unit disposed in the casing for feeding the recording sheet in a secondary scanning direction, the opposite outer jackets being coupled to the enclosure by a rack-and-pinion mechanism so as to be expandable and contractible with respect to the enclosure evenly in opposite lateral directions.

2. The expandable/contractible type portable printer according to claim 1, wherein the rack-and-pinion mechanism comprises racks respectively mounted at the opposite outer jackets, and a pinion mounted at the enclosure and meshing with the racks on upper and lower sides thereof.

3. The expandable/contractible type portable printer according to claim 1, wherein the rack-and-pinion mechanism comprises a plurality of rack-and-pinion mechanisms respectively located at front side, rear side and bottom of the expandable/contractible casing.

4. The expandable/contractible type portable printer according to claim 1, wherein the enclosure has a lower portion provided with a base plate supporting a platen on which the recording sheet is fed, the base plate being coupled to the opposite outer jackets by means of the rack-and-pinion mechanism.

5. The expandable/contractible type portable printer according to claim 4, wherein the base plate telescopically accommodates therein a pair of auxiliary platens respectively coupled to the opposite outer jackets.

6. The expandable/contractible type portable printer according to claim 1, wherein the enclosure is provided therein with a slide rail which is movable in the primary scanning direction by expanding or contracting operation of the outer jackets, the slide rail being fitted with a single stepless carriage scan shaft extending thereover for supporting and guiding the carriage in the primary scanning direction.

7. The expandable/contractible type portable printer according to claim 6, wherein the slide rail is coupled to a first wire driving pulley through a first wire for transmission while the carriage coupled to a second wire driving pulley through a second wire, the first wire driving pulley and the second wire driving pulley being arranged so as to be driven for rotation by a carriage driving motor.

8. The expandable/contractible type portable printer according to claim 7, wherein: the first wire driving pulley and the second wire driving pulley are coaxially assembled together; and the ratio between a diameter of the first wire driving pulley and a diameter of the second wire driving pulley is set to 2:1.

9. The expandable/contractible type portable printer according to claim 1, wherein the carriage is positioned centrally of the enclosure when the opposite outer jackets are contracted with respect to the enclosure.

10. The expandable/contractible type portable printer according to claim 1, wherein the enclosure is provided therein with a cap for hermetically sealing the printing head when the opposite outer jackets are contracted with respect to the enclosure.

11. The expandable/contractible type portable printer according to claim 10, wherein one of the racks respectively mounted at the opposite outer jacket is provided with a press-up member for pressing up the cap against the printing head to seal the printing head hermetically when the opposite outer jackets are contracted with respect to the enclosure.

12. The expandable/contractible type portable printer according to claim 1, further comprising a guide rail for sliding and guiding an ejection-side portion of the carriage, the guide rail comprising a laterally extending receiver groove of a concave shape in section formed above a sheet ejection outlet defined in a front portion of the enclosure, and a pair of insert members which are secured to the opposite outer jackets, respectively, and slidably fitted in the receiver groove.

13. The expandable/contractible type portable printer according to claim 1, wherein the enclosure has an underside to which a resilient member having a relatively high friction coefficient is bonded, while each of the opposite outer jackets has an underside provided with a pad member having a relatively low friction coefficient.

* * * * *